United States Patent [19]

Mackiewicz

[11] Patent Number: 5,006,970

[45] Date of Patent: Apr. 9, 1991

[54] INTERLOCK ELECTRICAL SOCKET MOUNT

[75] Inventor: Edward T. Mackiewicz, Elmwood Park, Ill.

[73] Assignee: Kenall Manufacturing Company, Gurnee, Ill.

[21] Appl. No.: 458,953

[22] Filed: Dec. 29, 1989

[51] Int. Cl.[5] ..... F21S 3/00

[52] U.S. Cl. ..... 362/217; 362/260; 362/429; 439/226; 439/234

[58] Field of Search ..... 362/217, 260, 429, 221, 362/382, 418; 439/242, 240, 241, 226, 232–235, 238, 544, 545, 562, 565, 569

[56] References Cited

U.S. PATENT DOCUMENTS

| | | | |
|---|---|---|---|
| 3,138,418 | 6/1964 | Dazleg et al. | 362/260 |
| 3,176,260 | 3/1965 | Pascucci | 362/217 |
| 4,422,132 | 12/1983 | Troubidge | 362/429 |
| 4,772,216 | 9/1988 | Szymanek | 362/217 |
| 4,814,954 | 3/1989 | Spitz | 362/217 |

*Primary Examiner*—Stephen E. Husar
*Assistant Examiner*—D. M. Cox
*Attorney, Agent, or Firm*—Michael G. Berkman

[57] ABSTRACT

In a fluorescent light fixture having a panel for supporting thereon an electrical socket assembly for holding a fluorescent tube, a simple, mechanical, manually-effected interlock for securing the socket assembly in a tube-receiving and supporting mode on the panel. The panel itself is formed with a non-rectangular cut-out zone for receiving an upwardly extending wall of the socket assembly inserted upwardly through the cut-out zone, and a base of the socket assembly being then shiftable arcuately to effect interengaging intercoupling between a laterally-opening slot in the base of the socket assembly and a projecting edge of the panel bounding the cut-out zone formed therein. A dimple-like deformation formed in the panel on an underside thereof defines a detent to deter inadvertent mechanical separation of the socket assembly from the panel.

6 Claims, 2 Drawing Sheets

INTERLOCK ELECTRICAL SOCKET MOUNT

BACKGROUND OF THE INVENTION

The present invention relates to electrical lighting fixtures. More particularly, the invention is directed to a fluorescent light fixture having a panel for supporting thereon an electrical socket assembly for holding a fluorescent tube.

In fluorescent fixtures of the general type in which the present invention finds utility, the socket assembly which supports the fluorescent tube is ordinarily fastened to a support panel by means of screws or equivalent mechanical fasteners These fasteners pass through the base of the socket assembly and are threadedly secured or bolted onto a support panel. The operation required is time consuming and requires that one take care to apply the correct degree of tension in the established system so that the assembly may be firmly secured and at the same time fracture of the mounting assembly be avoided The use of mechanical securing components such as nuts and bolts represents a significant expense added to the cost of the mounting assembly itself. It is, therefore, a principal aim of the present invention to provide, in a fluorescent tube mounting assembly, a simple yet highly effective and safe apparatus and method by which the tube-carrying mount may be secured to a supporting panel without the use of tools or auxiliary apparatus.

SUMMARY OF THE INVENTION

The present invention provides a mechanical arrangement and a method by which an electrical socket assembly for supporting a fluorescent lighting tube is mechanically interlocked onto a supporting base or panel to assume a stable, lamp-supporting orientation. The mechanical interlock is effected without the use of auxiliary fasteners of any type and without the use of tools.

An important feature of the present invention is that the securement of the lamp-supporting socket assembly is simplified, and at the same time is carried out at reduced cost and with a saving of time.

An important feature of the technique of the invention is that any weakening or possible fracture of the tube-supporting assembly is obviated.

A related feature of the invention is that the resulting structure has increased mechanical stability and strength.

Yet another feature contributing to the increased strength and stability of the socket assembly mount of the present invention is that the assembly is secured in a "closed frame" panel rather than in a panel in which end sections or edge sections are cut away, and thus, open. An important long-term benefit achieved through the use of the present invention is that the expected useful life of the socket mounting assembly is increased.

In a preferred embodiment of the invention the mounting panel is mechanically formed to provide a detent which inhibits the inadvertent shifting of the tube-mounting assembly to a non-support mode.

An important feature of the present invention is that it is readily functionable with and utilizing standard "tomb-stone" shaped socket assemblies It is a practical feature of the present invention that no special skills or training are required in order to enable one effectively and efficiently to complete the attachment of the tube carrying socket assembly to the supporting panel.

It is an important element of the present invention that the socket assembly supporting panel is prestamped to define a specific type of opening adapted to accommodate the insertion of a backwall component of the assembly upwardly therethrough.

A related feature of the invention is that with the socket assembly wall inserted upwardly through the prestamped opening in the support panel, the socket assembly may then be pivoted to effect engagement between the panel itself and the socket assembly, adjacent its base.

Yet another feature of the invention is that the slots into which portions of the bounding edge of the cut-out are insertable constitute slots which are ordinarily present in the socket mounting assemblies as conventionally fabricated, thus obviating any need for preshaping or modifying the socket supporting assemblies themselves.

It is a feature of the invention that the final attachment is effected by merely pivoting the socket supporting assembly once the wall of that assembly has been inserted upwardly through the prestamped opening.

Other and further features and advantages of the invention will be evident upon a reading of the following detailed description considered in conjunction with the drawings.

DESCRIPTION OF THE ILLUSTRATED EMBODIMENT

In effectuating the aims and purposes of the present invention, the structures involved include only the conventional, commercially-available socket assemblies and the usual type of support panel utilized in fluorescent lighting fixtures. No additional or auxiliary structures of any type are used or required.

In accordance with the practice of the present invention, the support panel is stamped to provide an opening through which the upstanding wall of the "tomb-stone" shaped socket assembly may be inserted. The stamped opening in the panel itself is generally rectangular but includes a wing or integrally formed laterally extending portion which is slidably received within an existing laterally opening slot formed adjacent the base of the socket assembly itself, thereby to establish a mechanical interengagement between the mounting assembly and the panel. Thereafter, the assembly is rotated somewhat to assume a proper orientation and, at the same time, to effect a stabilized mechanical orientation, the stabilization being enhanced through the expedient of a detent or protrusion which is prestamped into the panel itself In a preferred embodiment of the invention, the socket assembly is first inserted upwardly through the prestamped opening, then shifted slightly longitudinally and, finally, rotated through an angle to assume its final, secured position with a wing or flange of the panel penetrating a preexisting slot present in the socket assembly adjacent its base.

Figure 1:
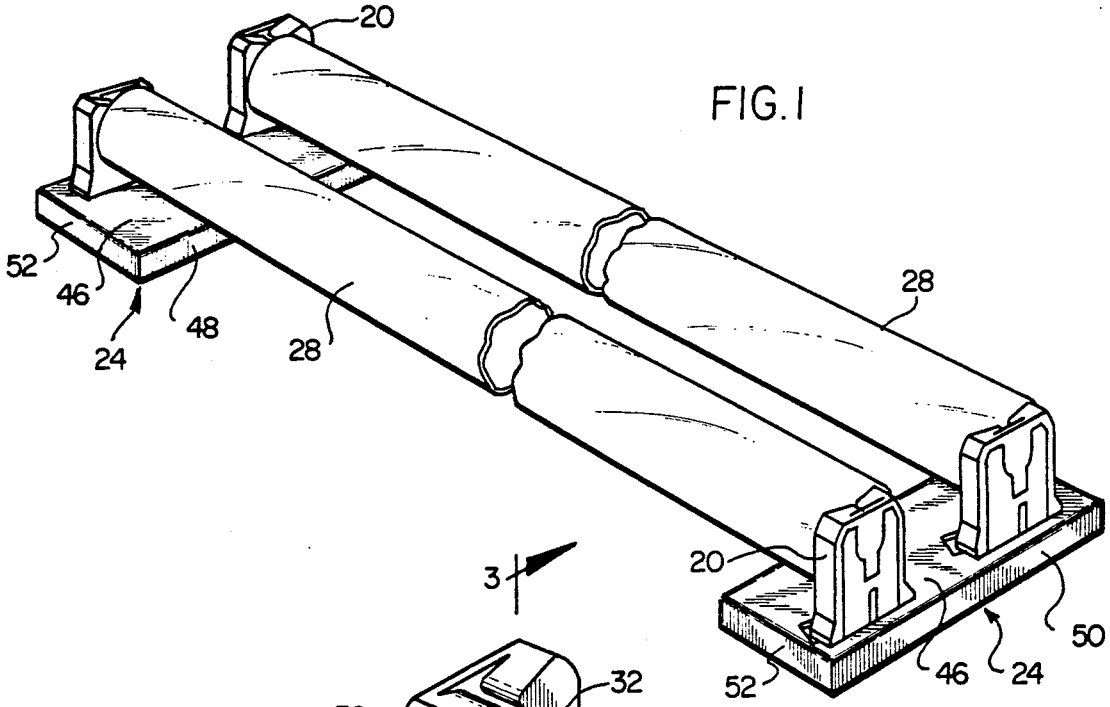
FIG. 1 is a perspective view showing lamp carrying socket assemblies seated on and fastened to support panels in accordance with the present invention.
Figure 2:
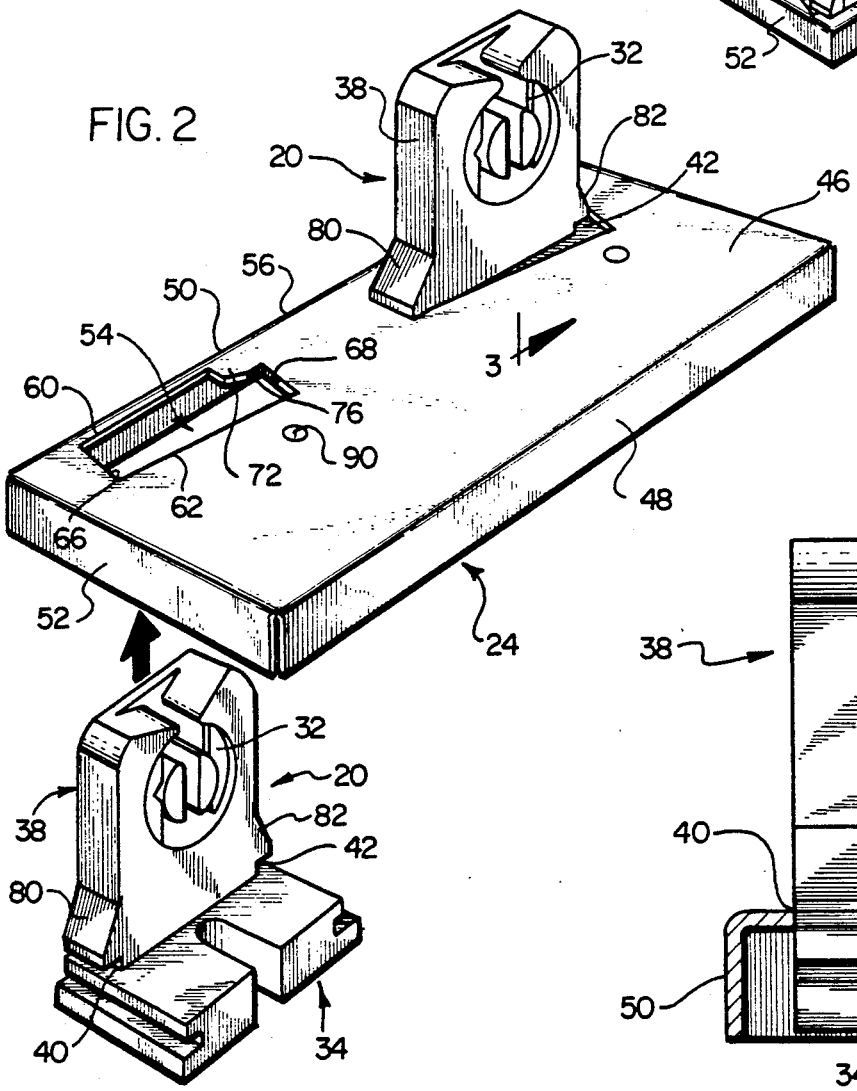
FIG. 2 is an enlarged perspective view showing a socket assembly and showing the socket assembly mounted on a support panel, in accordance with the present invention.
Figure 3:
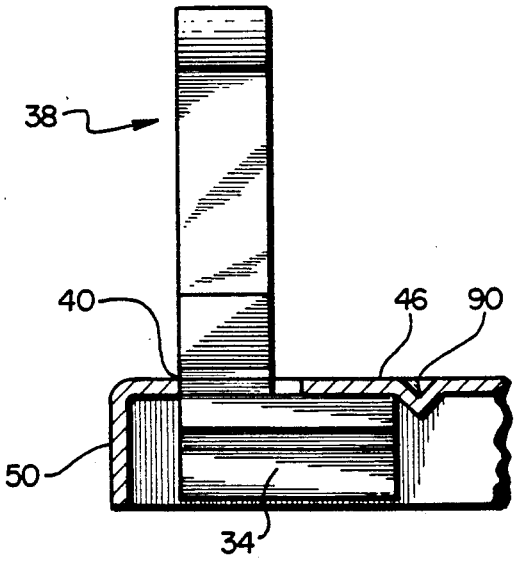
FIG. 3 is a cross-sectional view taken substantially on the lines 3—3 of FIG. 2 and showing the socket assembly extending through an opening in the support panel with the assembly locked in place.

Referring more particularly to the drawings, and specifically to FIGS. 1–3, for purposes of illustrative disclosure and not in any limiting sense, one preferred embodiment of the interlock electrical socket support assembly 20 is shown as mounted on the supporting panel 24, in accordance with the present invention. The socket assembly is of a generally "tomb-stone" shape and the metal support panel is of a type commonly employed in fluorescent electrical fixtures. In FIG. 1, the socket assemblies 20 are shown as secured on the support panel 24, with fluorescent tubes 28 mounted in the socket assembly carried receptacles 32, in operative position.

As best seen in FIG. 2, the socket assembly 20 includes a base 34 of generally block-like configuration and an integrally formed upstanding wall 38 projecting from the base at a rear zone thereof. At its upper end, the upstanding wall 38 is formed to define the receptacle 32 into which the cooperating end probes of the fluorescent tubes are inserted to complete an electrical circuit. Adjacent its juncture with the base 34, the vertical wall 38 of the socket assembly 20 is formed with slots 40 and 42 opening laterally at each of opposed sides of the vertical wall 38. The above description of the socket assembly conforms to structures which are available commercially and does not pertain to any special adaptation made in the socket assembly for the purposes of the present invention.

The socket assembly support panel 24 (FIG. 2) constitutes a generally planar metal sheet 46 side edge portions of which are bent downwardly at 90° to define elevating side skirts 48 and 50 and end skirts 52. The vertical height of the skirts 48, 50 and 52 is equal to or slightly exceeds the vertical height of the base 34 of the socket assembly 20, as shown in FIG. 3. The top metal sheet 46 of the panel 24 is formed with die cut openings 54 adjacent a longitudinally extending edge 56 of the panel 24, the cut-outs 54 being spaced from each other for accommodating a gang of lighting tubes 28 of the fluorescent light fixture The cut-outs 54 are generally somewhat trapezoidal in form with one principal edge 60 paralleling the edge 56 of the panel sheet 46. An opposite principal edge 62 bounding the cut-out 54 is longer than the first edge 60. Extending generally normally of the longer edge 62, at each of opposed end extremities thereof are side edges 66 and 68, each of a length corresponding essentially to the front-to-rear depth of the upstanding wall 38 of the socket assembly 20.

Figure 4:
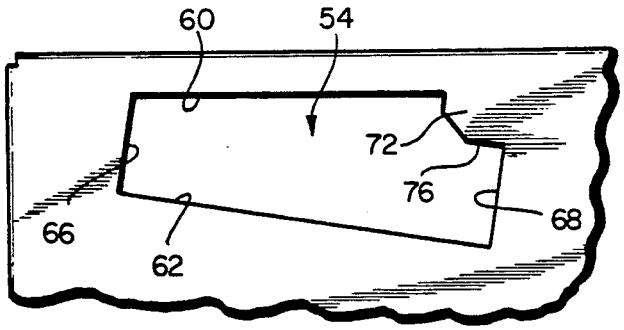
FIG. 4 is an enlarged fragmentary top view of a socket assembly mounting panel formed with a cut-out for accommodating the base and for mechanically intercoupling with an upstanding wall of the socket assembly.
Figure 5:
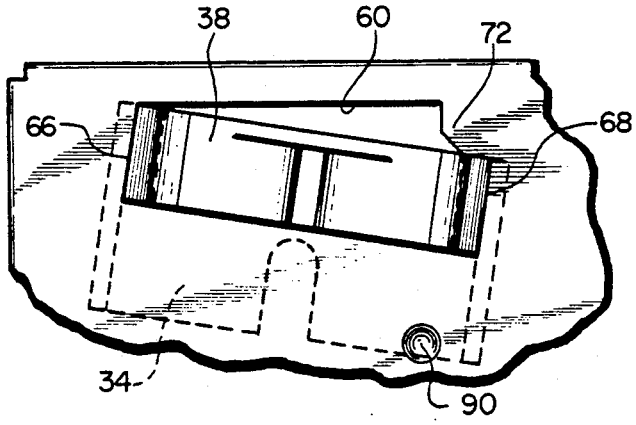
FIGS. 5, 6 and 7 are top plan views indicating, schematically, steps or stages in the insertion of the wall of a socket assembly upwardly through the cut-out in the panel (FIG. 5), the subsequent lateral displacement of the assembly to effect engagement of one end of the base with the support panel (FIG. 6), and the pivotal shifting of the base of the assembly (FIG. 7) to effect engagement of an opposite end of the assembly with the support panel, and showing a surface-deforming detent formed in the panel to deter rotational displacement and resulting inadvertent separation of the socket assembly from the panel.

At its broader base which includes a partial base wall 68, the generally trapezoidal opening 54 is invaded by a protrusion or wing 72 which projects into the cut-out zone 54 at a lower broadened base zone of the generally trapezoidal cut-out 54, as shown in FIGS. 2 and 4. Also, as seen in FIG. 4 and as depicted schematically in FIGS. 5 and 6, the end edge 62 and the side edges 66 and 68, together with a fragmentary edge 76 bounding the cut-out 54 together delineate an opening for accommodating the insertion therethrough upwardly through the panel 24 of the upstanding wall 38 of the socket assembly 20, as will be explained in greater detail in the paragraphs below.

As clearly shown in FIG. 2, the upstanding wall 38 of the socket assembly 20 is formed with laterally extending angled, outwardly flared lower protrusions 80 and 82 which define, at their lower extremities, the maximum side-to-side dimension of the upstanding wall 38 and which, therefore, delineate as well the minimum length of the cut-out zone 54, corresponding to the length of the side edge 62.

The manner in which the socket assembly 20 is inserted into and retained in place on the support panel 24 is described below with reference to FIGS. 4-8, the socket assembly 20 ultimately assuming the orientation shown in FIGS. 7 and 8, and visually evident in FIG. 2. In order to mount the socket assembly "on" the panel 24, the following simple steps are carried out. The upstanding wall 38 of the socket assembly 20 is inserted upwardly through the cut-out 54 in the panel sheet 46, from the underside of the sheet 46 so that the entire wall 38 clears the upper face of the sheet 46. At the same time, the sheet 46 abuts the base 34 of the socket assembly 20 to position the end opening slots 40 and 42 in the same plane as the sheet 46 of the panel 24, as indicated schematically in FIG. 5 and in FIG. 6. In this particular stage of assembly the lower part of the wall 38 occupies that part of the cut-out 54 which includes the partial edge 76 as one of its bounding limits (FIG. 4).

Figure 6:
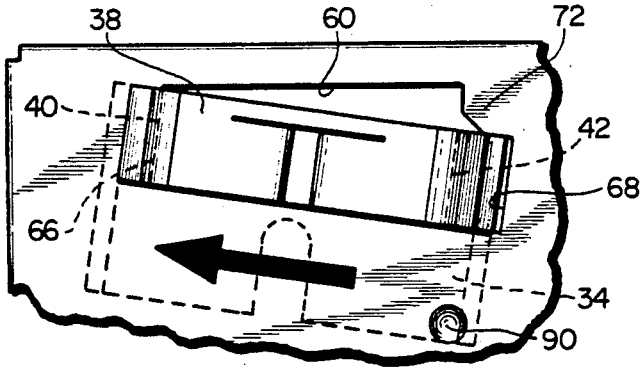

As a second step in the simple assembly procedure, the socket assembly 20 is moved laterally within the cut-out 54 so that the edge 66 of the panel at the narrower portion of the trapezoidal cut-out 54 enters into the engage within the slot 40 at the base of the wall 38 of the socket assembly 20, as indicated schematically in FIG. 6. The final simple step is to pivot the socket assembly at its end engaged on the side edge 66 of the cut-out 54 so as to bring the wing or flange 72 slidably into the slot 42 at the opposite side edge of the upstanding wall 38, as indicated schematically in FIG. 7, so that the socket assembly 20 assumes its supported, functional position.

Figure 7:
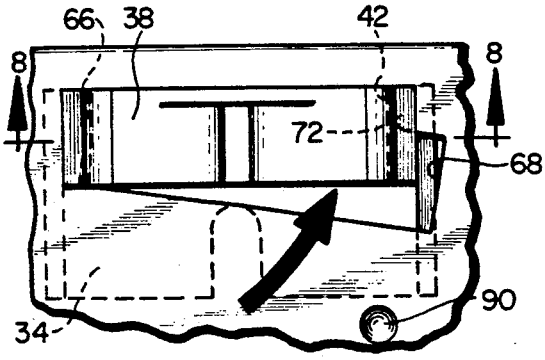
Figure 8:
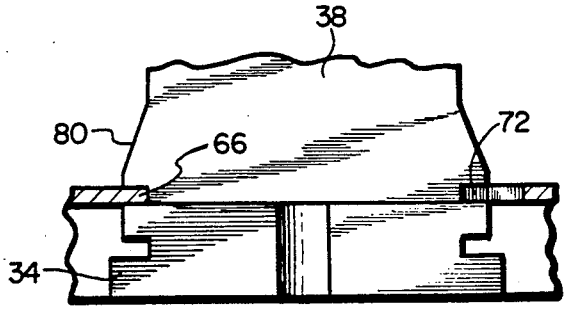
FIG. 8 is a cross-sectional view taken substantially in the lines 8-8 of FIG. 7, and showing the socket assembly secured in place with portions of the panel lockingly projecting into opposed lateral slots formed at the base of the socket assembly.

Referring further to FIG. 7, and as also seen in FIG. 2, the sheet 46 of the panel 24 is formed with a dimple or a depression 90 forming a detent which functions, on the undersurface of the panel 46, to deter the inadvertent lateral displacement of the base 34 to prevent inadvertent shifting of the base 34 and concurrent separation of the socket assembly 20 from the encoupling flange 72 of the panel sheet 46.

It will be clearly understood from the foregoing that the present invention is directed to a simple yet highly effective technique and structure by means of which a socket mounting assembly may be readily and simply installed and retained in place on a supporting panel, without the use of any tools, and without any need for auxiliary apparatus such as screws or nut and bolt assemblies. While the present invention has been described with respect to a preferred embodiment, including a preferred contour of the stamped cut-out in the supporting flange or sheet, it will be readily understood by those skilled in the art that obvious variations may be made without departing from the spirit or scope of the present invention. All such modifications may, in the light of the present disclosure, be made without the exercise of the inventive faculty Accordingly, all such modifications are deemed to be within the scope of the appended claims.

What is claimed is:

1. In a fluorescent light fixture including panel means for supporting thereon an electrical socket assembly, said socket assembly having a base and an upstanding wall, said wall being adapted for supporting a fluorescent lamp operatively coupled thereto, the improvement wherein said panel means is formed with cut-out zone means including a generally elongate opening for insertably receiving said upstanding wall of said socket assembly inserted upwardly through said panel means, said panel means including, in a sector of a perimetric margin bounding and defining said cut-out zone means, wing means integrally formed with said panel means and projecting toward said opening for invasively slidably penetrating said socket assembly at an opposed groove-like slot formed in said socket assembly adjacent said base and laterally thereof, said wing means constituting means for effecting mechanical intercoupling between said panel means and said socket assembly upon insertion of said wall means of said socket assembly upwardly through said opening in said panel means and upon arcuately shifting displacement of said base of said socket assembly toward said wing means for positively seating said wing means of said panel means within the slot formed in said socket assembly, lockingly to engage said socket assembly with said panel means.

2. The improvement as set forth in claim 1 and further comprising detent means integrally formed with said panel means for mechanically opposing positional reorientation of said socket assembly to a mode of disengagement from said wing means, and to prevent unintended withdrawal of said socket assembly from said cut-out zone means and resulting separation of said socket assembly from said panel means.

3. The improvement as set forth in claim 2, wherein said detent means comprises an embossed deformation formed in said panel means integrally therewith and projecting downwardly of a plane defined by an underside expanse of said panel means, said deformation being adjacent an edge of said panel means bounding said opening in said panel means and positioned in substantially laterally abutting proximity to an edge of said base of said socket assembly when said assembly is secured in a lamp-supporting orientational locked mode on said panel means.

4. Apparatus for mounting a lighting tube of a fluorescent light on a fixture, said apparatus comprising a socket assembly including a base, and an upstanding wall surmounting said base, said socket assembly being formed with a horizontal slot adjacent said base and opening laterally thereof, panel means of the fixture for supporting said socket assembly thereon, said panel means being formed with a cut-out opening including key-way means for intercoupling, locking engagement with said socket assembly adjacent said base thereof for supporting said socket assembly in a lamp-accepting functional disposition on said panel means, said wall of said socket assembly being insertable upwardly through said opening in said panel means and said assembly being arcuately shiftable within said opening and a plane paralleling said panel means for effecting mechanical intercoupling of said socket assembly with said panel means upon sliding entry of said keyway means into the slot adjacent said base of said socket assembly.

5. The apparatus as set forth in claim 3 and further comprising detent means integrally formed in said panel means as a deformation thereof, to abut said base of said socket assembly and to interfere with lateral movement of said base to an orientation in which said base is uncoupled from said panel means.

6. In a fluorescent light fixture including socket assembly means for functional connection with a fluorescent lamp, and panel means for supporting said socket assembly thereon, said socket assembly means being of a type which includes a base and an upstanding wall carried on said base, and in which said assembly is formed with a horizontally extending laterally opening slot adjacent said base of said socket assembly, the method of securing said socket assembly on said panel, means said method including the steps of forming a through opening in said panel means, and contouring said opening to define keyway means including wing means for invasive entry of said wing means into said slot in said socket assembly means, inserting said wall of said socket assembly means upwardly through the contoured said opening in said panel means, arcuately shifting said socket assembly means to effect entry of said wing means into said slot, mechanically to intercouple said socket assembly means with said panel means to prevent vertical displacement and withdrawal of said socket assembly from said panel means, deforming said panel means downwardly in a zone adjacent said base of said socket assembly means to define embossed, dimple like detent means for deterring lateral displacement of said base of said socket assembly means to a panel-disengaging orientation.

* * * * *